United States Patent [19]

Evans et al.

[11] Patent Number: 4,975,996

[45] Date of Patent: Dec. 11, 1990

[54] MATTRESS

[76] Inventors: Alan G. Evans, 213 McCraney Street West, Oakville, Ontario, Canada, L6H 1H8; Ewan J. Main, 7 Pintail Court, Guelph, Ontario, Canada, N1C 1A8

[21] Appl. No.: 416,464

[22] Filed: Oct. 3, 1989

[51] Int. Cl.[5] ..... A47C 27/16

[52] U.S. Cl. ..... 5/464; 5/481

[58] Field of Search ..... 5/447, 448, 462, 464, 5/468, 481

[56] References Cited

U.S. PATENT DOCUMENTS

| | | | |
|---|---|---|---|
| 3,066,928 | 12/1962 | Lawrence et al. | 5/481 X |
| 3,319,274 | 5/1967 | Upton | 5/481 |
| 4,099,278 | 7/1978 | Parisi | 5/481 X |
| 4,190,697 | 2/1980 | Ahrens | 5/481 X |
| 4,365,371 | 12/1982 | Boussarogue | 5/464 X |
| 4,580,301 | 4/1986 | Ludman et al. | 5/481 X |
| 4,673,452 | 6/1987 | Awdhan | 5/481 X |

FOREIGN PATENT DOCUMENTS

| | | | |
|---|---|---|---|
| 1387195 | 3/1975 | United Kingdom | 5/464 |

*Primary Examiner*—Michael F. Trettel

*Attorney, Agent, or Firm*—Nixon & Vanderhye

[57] ABSTRACT

A matress formed from foam material is provided. The mattress generally comprises a foam body having an upper surface for supporting a user and a lower surface for resing on a support. An inner core region formed from foam material having a greater Indentation Force Deflection (I.F.D.) co-efficient than the remainder of the foam body is provided therein. The inner core region extends substantially along the length of the mattress and provides greater support in the mattress along an axis substantially parallel to the longitudinal axis of the mattress.

19 Claims, 5 Drawing Sheets

MATTRESS

The present invention relates to a body support and in particular to a mattress

Mattresses are well known in the art and developments thereto to increase support and comfort are continually being sought For example, U.S. Pat. No. 3,846,857 to Weinstock shows a polyurethane foam mattress having various regions of different densities. The regions are located at various positions along the length of the mattress and extend across the entire width of the mattress. This permits the mattress to exert a desired pressure to particular portions of a user when a user is supported on the mattress. However, although the mattress provides improved support to different areas of the body of a user, a problem exists in that the mattress does not provide compensation in the event that a user lies in the same region of the mattress during each use. Thus, if a user lies in the same region of the mattress during each use, as typically occurs, the mattress will weaken in that region causing the mattress to sag after prolonged use.

U.S. Pat. No. 4,713,854 to Graebe shows a foam cushion having strips of arch-shaped resilient foam material formed therein. The strips are arranged in rows and provide a constant force on a body resting on the cushion regardless of the deformation of the cushion. However, the same problem still exists in that this cushion does not provide compensation in the region on which a user typically lies during each use.

It is therefore an object of the present invention to obviate or mitigate the above disadvantages by providing a novel mattress.

Broadly stated the present invention provides a mattress formed from foam material comprising:

a foam body having an upper surface for supporting a user and a lower surface for resting on a support, said foam body having a longitudinal axis and including an inner core region formed from one type of foam material type of foam material being firmer than the remainder of said foam body, said inner core region extending substantially along the length of said mattress and providing increased support in said mattress along an axis substantially parallel to the longitudinal axis of said mattress.

Preferably, the inner core provides substantially continuous and even support along the entire axis and has an Indentation Force Deflection (I.F.D.) co-efficient at least two times greater than the remainder of the foam body. It is also preferred that the inner core includes symmetrical upper and lower surfaces, the upper and lower surfaces having a sinusoidal configuration across the width of the mattress. The portion of the inner core region having the greatest thickness is positioned on the axis to provide the increased support. The axis is positioned to extend along the region of the mattress on which a user typically lies during each use.

Preferably, the upper and lower surfaces have convolutions formed thereon to facilitate air flow beneath a user supported on the mattress and to allow either side of the mattress to support a user.

The present mattress provides advantages in that the additional support provided by the inner core region reduces sag and increases the lifetime of the mattress. Moreover, the design of the mattress provides an overall firmer feel without reducing the initial softness felt by a user lying on the mattress. Furthermore, since the present mattress uses foams of different strengths and geometries, the increased performance of the mattress is achieved at a substantially lower cost than a foam mattress formed from a single type of higher grade foam material.

Embodiments of the present invention will now be described by way of example only with reference to the accompanying drawings in which.

Figure 1:
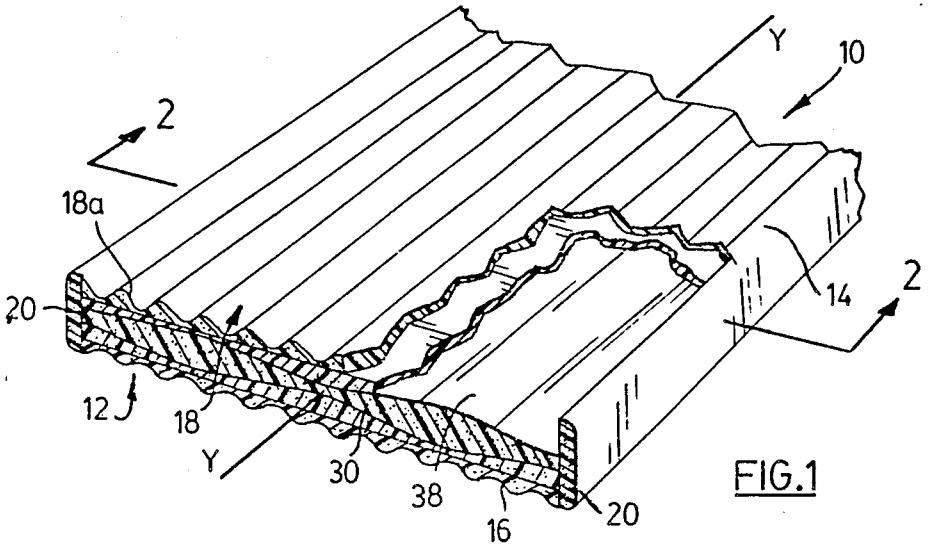
FIG. 1 is a partial perspective cutaway view of a mattress.

Referring to FIGS. 1 to 5, a mattress formed from polyurethane foam material is shown and is generally indicated by reference numeral 10. The mattress 10 generally comprises a foam body 12 having an upper surface 14 for supporting a user and a lower surface 16 for resting on a flat surface such as a bed frame or box spring. The upper and lower surfaces 14 and 16 respectively have convolutions 18 formed therein to define a wave-shaped pattern. The mattress 10 is designed in this manner to permit either side of the mattress 14,16 to be used as the upper supporting surface. Rails 20 formed from foam material extend along the four sides of the foam body 12 and are secured thereto via a gluing operation.

The foam body 12 is divided into five regions namely an upper convoluted region 26, an upper surround region 28, an inner core region 30, a lower surround region 32 and a lower convoluted region 34. The two surround regions 28, 32 are disposed on either side of the inner core region 30 and provide flat surfaces 36 on to which the convoluted regions 26, 34 lie. The two regions 26, 34 and the two surround regions 28, 32 are formed from polyurethane foam having an I.F.D. coefficient of a first value. The thickness of the two regions 26,34 is substantially constant and is chosen to be approximately 3.0 inches extending from the surface 36 to a peak **18*a* in the convolutions 18**.

The inner core region 30 is symmetrical about a horizontal axis X with the upper and lower surfaces 38 of the inner core region 30 being of a generally sinusoidal configuration in a direction transverse to the longitudinal axis Y of the mattress 10. As can be seen, the inner core region 30 has two peaks 40, when viewed in cross-section with the two peaks 40 being equidistantly spaced on either side of the longitudinal axis Y of the mattress 10. The peaks extend substantially along the entire length of the mattress and are disposed below the upper surface 14 of the mattress 10 in the areas where users typically lie when using the mattress 10. The inner core region 30 is also formed from polyurethane foam. However, the foam selected to form the inner core 30 is typically chosen to have an I.F.D. co-efficient of a second value which is at least two times greater than the I.F.D. co-efficient of the foam forming regions 26,28,32 and 34 respectively. The inner core 30 is also shaped so that the thickness varies from approximately 2 inches at the peaks 40 to 1 inch at the longitudinal axis Y of the mattress 10 and at each side thereof adjacent the rails 20. The combined thickness of the inner core region 30 and the two surround regions 28,32 is maintained substantially constant and is chosen to be approximately 4 to 5 inches.

Figure 2:
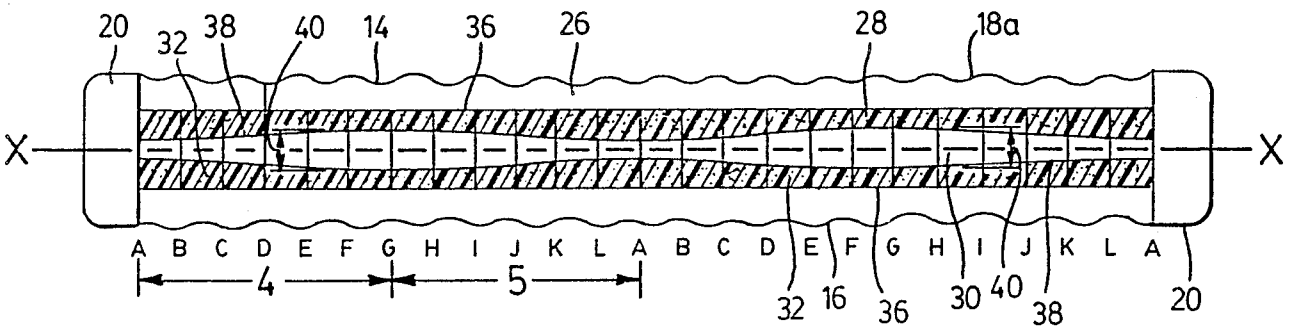
FIG. 2 is a sectional view of the mattress illustrated in FIG. 1 taken along line 2—2.

When a user typically lies on a mattress 10, the user generally lies on a specific area of the mattress. For example, in a single bed, a user generally lies along the longitudinal axis of the mattress. However, in a double bed, a user or users typically lie along an axis parallel to but spaced from the longitudinal axis of the mattress. As shown in FIGS. 1 and 2, the present double mattress 10 is provided with an inner core 30 having a pair of peaks 40 which are equidistantly spaced from the longitudinal axis Y of the mattress. The peaks 40 extend along the entire length of the mattress. The peaks 40 are positioned to extend along the area on which a user typically lies to provide increased support in the mattress in those regions. This increases the lifetime of the mattress and reduces sag.

Figure 3:
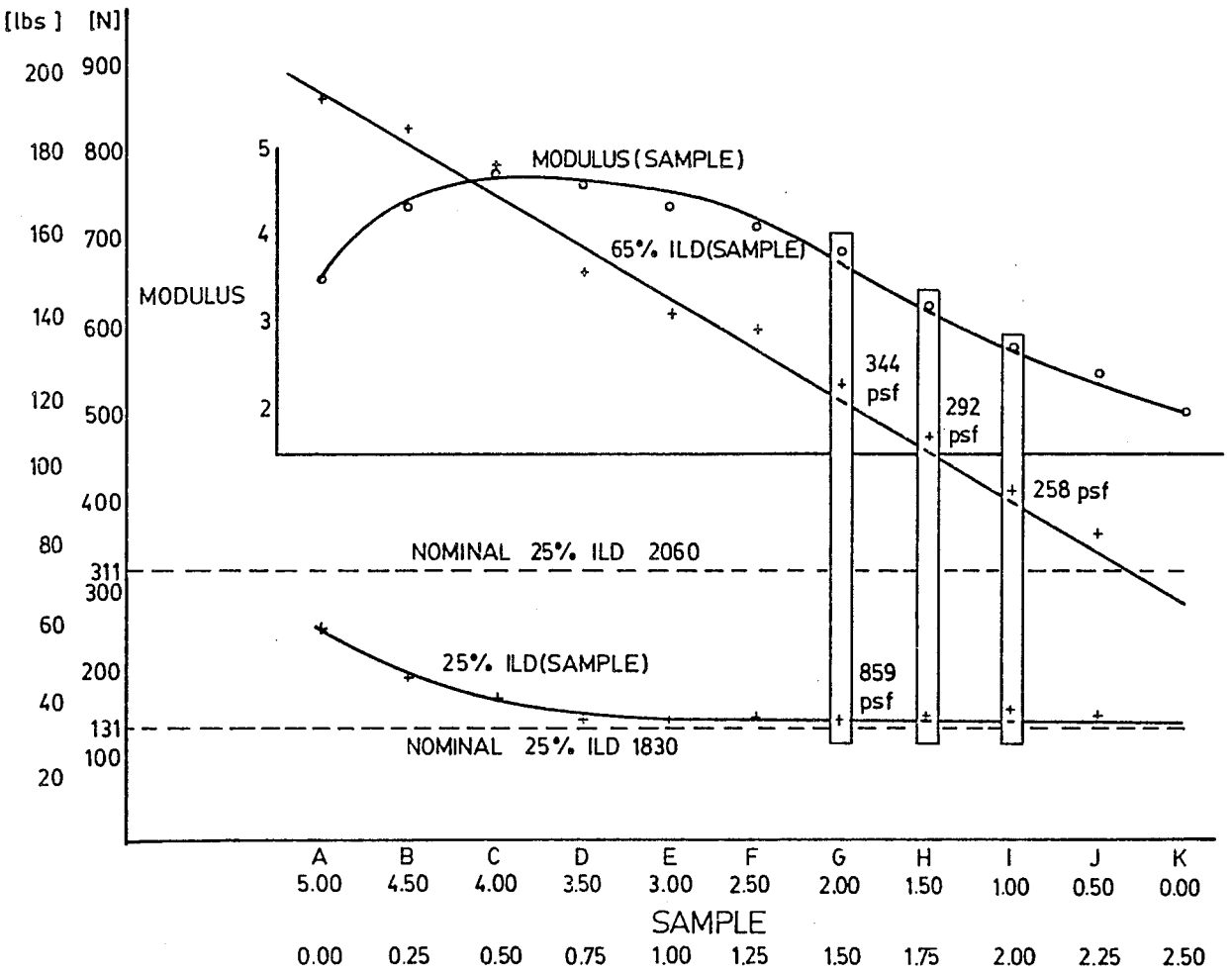
FIG. 3 shows graphs illustrating characteristics of a plurality of mattress configurations.
Figure 4:
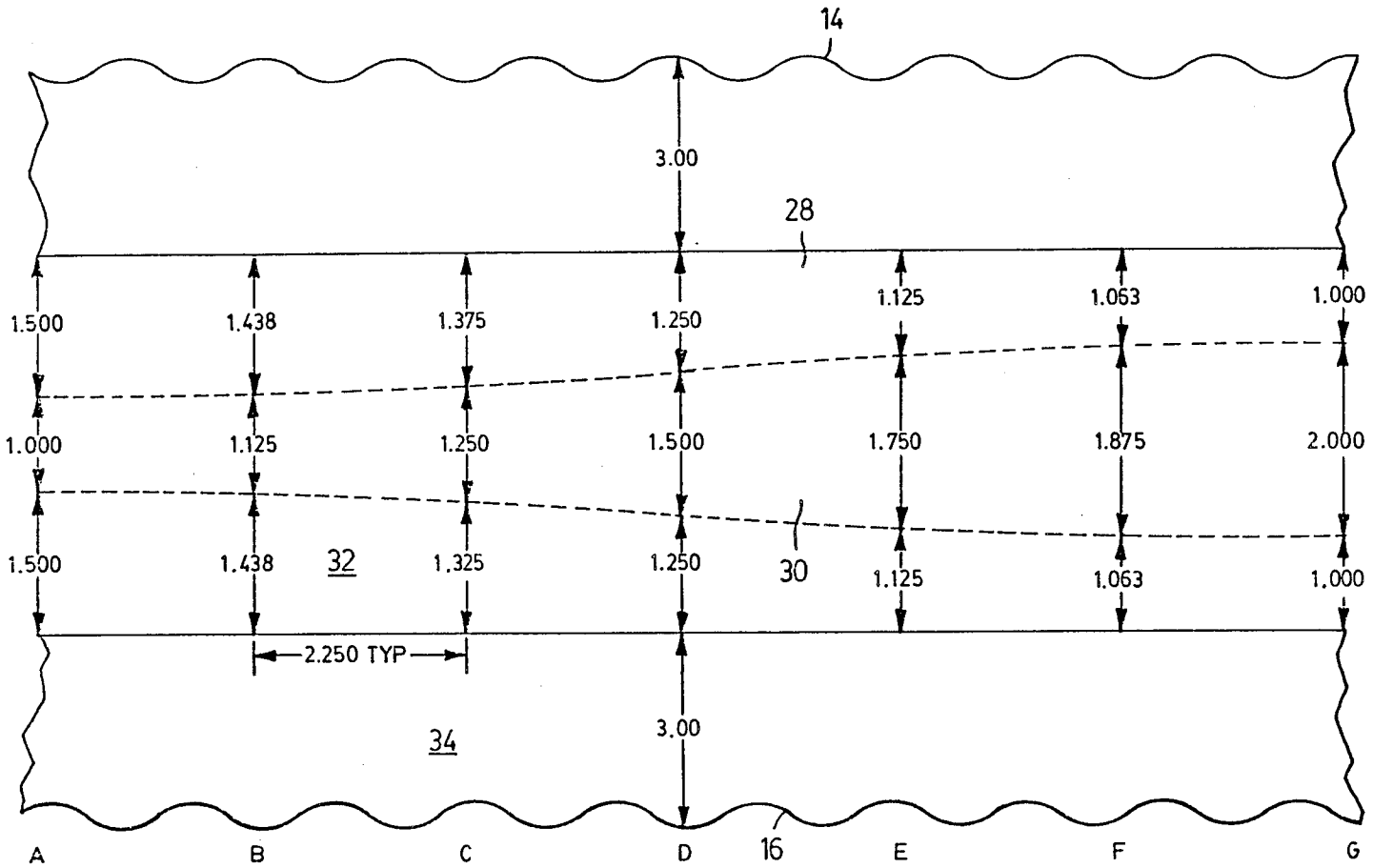
FIGS. 4 and 5 are enlarged sectional views of a portion of the, mattress illustrated in FIG. 2.
Figure 5:
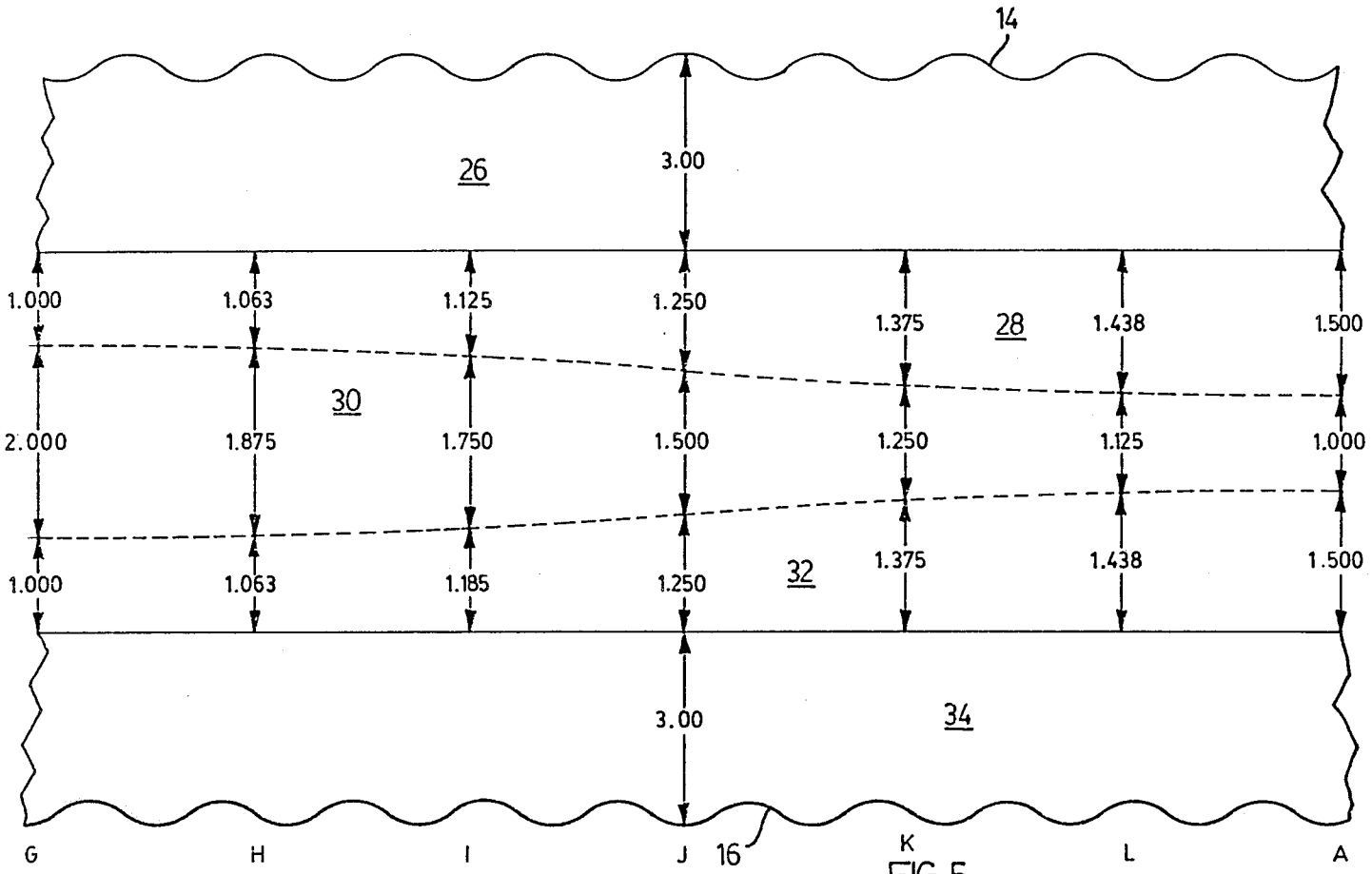

FIG. 3 illustrates characteristics of a plurality of mattress configurations having different thicknesses of inner core regions 30 and surround regions 28,32. As can be seen, FIG. 3 shows a 25% I.F.D. curve, a 65% I.F.D. curve and modulus levels for eleven mattress samples formed from 1830 and/or 2060 polyurethane foam material. The samples progressed from having an inner core of 5 inches in thickness with no surround regions, to a mattress sample having no inner core region 30 and 5 inches of surround region. All eleven samples included upper and lower regions 26,34 having a thickness of 1½ inches and thus, each sample was approximately 8 inches in thickness, this being the thickness of a typical mattress.

For clarity, the I.F.D. measurements are standard tests in the polyurethane foam industry. The 25% I.F.D. co-efficient relates to the force required to press an eight inch diameter plate down a distance of 25% of the thickness of the foam sample. Similarly, the 65% I.F.D. test is determined in the same manner and thus, relates to the force required to press the plate down a distance of 65% of the thickness of the foam sample. The modulus curve relates to the ratio of the 65% I.F.D. value to the 25% I.F.D. co-efficient for each foam sample. The thickness of the regions 28 to 32 in the present mattress 10 were chosen so that the inner core has an 25% I.F.D. co-efficient approximately two times greater than the 25% I.F.D. co-efficient of the remainder of the mattress. This results in a mattress which provides a firmer overall feel whilst still maintaining the initial softness when used by a person.

Figure 6:
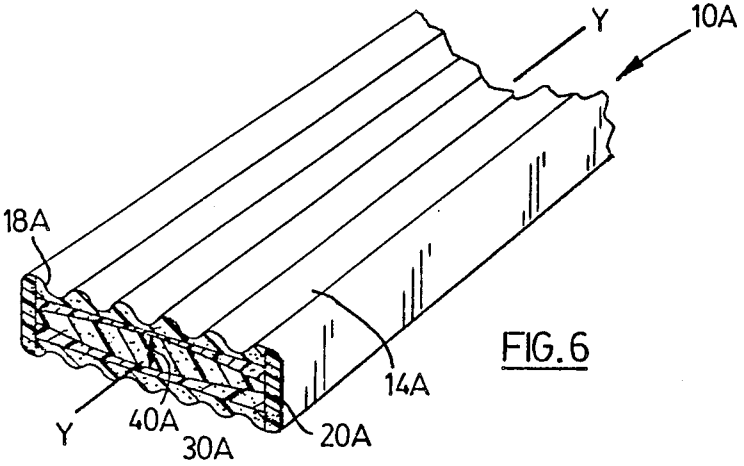
FIG. 6 is a partial perspective and partial sectional view of another embodiment of a mattress.

Referring now to FIG. 6, another embodiment of the mattress is shown. In this embodiment like reference numerals will be used to indicate like components with an "A" added for clarity. In this embodiment, the inner core region 30A of the mattress 10A is also symmetrical about the longitudinal axis Y of the mattress but has only one peak 40A formed therein which lies on the longitudinal axis Y. This design of the inner core region 30A is suitable for single beds wherein only one person typically lies on the upper surface 14A of the mattress 10A. In use, since a person lying on a single bed typically lies along the center line of the bed, the provision of the inner core 30A positioned in this manner provides the necessary support to increase the lifetime of the mattress and inhibit sag even after prolonged use.

Figure 7:
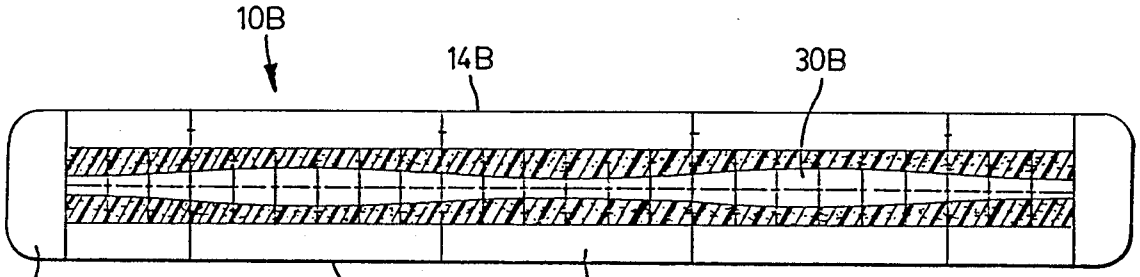
FIG. 7 is a sectional view of still yet another embodiment of a mattress.

Referring now to FIG. 7, yet another embodiment of the mattress is shown. In this embodiment, like reference numbers will be used to indicate like components with a "B" added in clarity. In this embodiment, the upper and lower surfaces 14B, 16B of the mattress 10B are substantially smooth to provide generally flat upper and lower surfaces as opposed to convoluted surfaces.

The present mattress provides advantages in that the design of the inner core region increases the lifetime of the mattress and inhibits sag by providing greater support along the axis or axes on which users typically lie. Moreover, since an inner high I.F.D. co-efficient foam is used to form the inner core, the mattress provides a firmer overall feel. Furthermore, the provision of the inner core having a high I.F.D. co-efficient allows the performance of the mattress to be increased at a relatively low cost.

It should be apparent to one of skill in the art that various modifications can be made to the present invention without departing from the scope thereof as defined by the appended claims.

We claim:

1. A mattress formed from foam material comprising: a foam body having an upper surface for supporting a user and a lower surface for resting on a support, said foam body having a longitudinal axis and including an inner core region formed form one type of foam material, said one type of foam material being firmer than the remainder of said foam body, said inner core region extending substantially along the length of said mattress and providing increased support in said mattress along an axis substantially parallel to the longitudinal axis of said mattress.

2. A mattress as defined in claim 1 wherein the inner core region provides substantially continuous and even support along the entire axis.

3. A mattress as defined in claim 2 wherein said inner core region decreases in thickness in a direction transverse to said axis.

4. A mattress as defined in claim 1 wherein said upper and lower surfaces have convolutions formed thereon.

5. A mattress as defined in claim 1 wherein said inner core region is formed from foam material having a 25% Indentation Force Deflection co-efficient approximately two times greater than the 25% Indentation Force Deflection co-efficient of the foam material forming the remainder of said mattress.

6. A mattress as defined in claim 1 wherein said inner core region is formed from 1830 polyurethane foam material and wherein the remainder of said foam body is formed from 2060 polyurethane foam material.

7. A mattress formed from foam material comprising: a foam body having an upper surface for supporting a user and a lower surface for resting on a support, said foam body having a longitudinal axis and including an inner core region formed from one type of foam material, said one type of foam material being firmer than the remainder of said foam body, said inner core region extending substantially along the length of said mattress and providing increased support in said mattress along an axis substantially parallel to the longitudinal axis of said mattress, said inner core region further decreasing in thickness in a direction transverse to said axis.

8. A mattress as defined in claim 7 wherein said inner core region provides substantially continuous and even support along said axis.

9. A mattress as defined in claim 8 wherein said upper and lower surfaces have convolutions formed thereon.

10. A mattress as defined in claim 8 wherein said inner core region is formed from foam material having a 25% indentation force deflection coefficient approximately two times greater than the 25% indentation force deflection coefficient of the foam material forming the remainder of said mattress.

11. A mattress as defined in claim 8 wherein said inner core region is formed from 1830 polyurethane foam material and wherein the remainder of said foam body is formed from 2060 polyurethane foam material.

12. A mattress as defined in claim 8 wherein the inner core region is symmetrical about a substantially horizontal axis and includes upper and lower surfaces, said upper and lower surfaces being generally sinusoidal in configuration in a direction transverse to said longitudinal axis and defining at least one region of increased thickness, said one region being positioned on said axis and extending therealong.

13. A mattress as defined in claim 12 wherein said inner core region includes two regions of increased thickness separated by a region of reduced thickness, said one region of reduced thickness being located on the longitudinal axis and extending therealong, said regions of increased thickness being equidistantly spaced from the longitudinal axis on opposite sides thereof and providing increased support along axes extending substantially parallel to said longitudinal axis.

14. A mattress as defined in claim 13 wherein the thickness of said regions of increased thickness with respect to said region of reduced thickness is in the ratio of about 2 to 1.

15. A mattress as defined in claim 12 wherein said axis and said longitudinal axis are coincident.

16. A mattress as defined in claim 15 wherein said inner core region is formed from foam material having a 25% Indentation Force Deflection co-efficient approximately two times greater than the 25% Indentation Force Deflection co-efficient of the foam material forming the remainder of said mattress.

17. A mattress as defined in claim 15 wherein said inner core region includes a single region of increased thickness disposed between regions of reduced thickness positioned adjacent the sides of the mattress, the thickness of said region of increased thickness with respect to said regions of reduced thickness being in the ratio of about 2 to 1.

18. A mattress as defined in claim 17 wherein the thickness of said region of increased thickness with respect to the thickness of said mattress is in the ratio of about 1 to 4.

19. A mattress as defined in claim 12 wherein the thickness of said regions of increased thickness with respect to the thickness of said mattress is in the ratio of about 1 to 4.

* * * * *